US006661397B2

(12) United States Patent
Mikami et al.

(10) Patent No.: US 6,661,397 B2
(45) Date of Patent: Dec. 9, 2003

(54) EMISSIVE DISPLAY USING ORGANIC ELECTROLUMINESCENT DEVICES

(75) Inventors: Yoshiro Mikami, Hitachiota (JP); Takayuki Ouchi, Hitachi (JP); Yoshiyuki Kaneko, Hachioji (JP); Toshihiro Sato, Mobara (JP)

(73) Assignee: Hitachi, Ltd., Tokyo (JP)

( * ) Notice: Subject to any disclaimer, the term of this patent is extended or adjusted under 35 U.S.C. 154(b) by 113 days.

(21) Appl. No.: 09/940,886

(22) Filed: Aug. 29, 2001

(65) Prior Publication Data

US 2002/0140641 A1 Oct. 3, 2002

(30) Foreign Application Priority Data

Mar. 30, 2001 (JP) ..... 2001-098864

(51) Int. Cl.[7] ..... G09G 3/30

(52) U.S. Cl. ..... 345/76; 345/36; 345/42; 345/45; 345/55; 345/77; 345/82; 345/83; 345/90; 345/98; 345/204; 345/205; 345/214; 315/169.3; 340/825.81

(58) Field of Search ..... 345/36, 42, 45, 345/55, 76, 77, 82, 83, 90, 98, 204, 205, 214, 690; 315/169.3; 340/825.81

(56) References Cited

U.S. PATENT DOCUMENTS 5,886,474 A * 3/1999 Asai et al. ..... 315/169.1
6,130,713 A * 10/2000 Merrill ..... 348/308
6,169,532 B1 * 1/2001 Sumi et al. ..... 345/98
6,177,767 B1 * 1/2001 Asai et al. ..... 315/169.1
6,191,534 B1 * 2/2001 Schuler et al. ..... 315/169.3
6,417,825 B1 * 7/2002 Stewart et al. ..... 345/77
6,529,178 B1 * 3/2003 Kimura ..... 345/76

* cited by examiner

*Primary Examiner*—Bipin Shalwala
*Assistant Examiner*—Vincent E. Kovalick
(74) *Attorney, Agent, or Firm*—Antonelli, Terry, Stout & Kraus, LLP

(57) ABSTRACT

An emissive display using an organic electroluminescent device is provided, in which the pixel circuit is simplified, the aperture ratio is increased, high resolution is achieved, and the power consumption is reduced. In the configuration, among the two sets of inverter circuits, one set of inverter circuit is formed by a circuit connecting an organic electoluminescent device and a transistor in series, and a transistor of a memory circuit is omitted. Also, in the mutual connection of the two sets of inverters, display data is inputted to a line connected to the gate of the transistor connected in series with the organic electoluminescent device, and owing to this connection, the write load is reduced, and the high resolution is achieved by enabling to write at high speed.

11 Claims, 11 Drawing Sheets

EMISSIVE DISPLAY USING ORGANIC ELECTROLUMINESCENT DEVICES

BACKGROUND OF THE INVENTION

The present invention relates to a display, in particular, to an emissive display using organic electroluminescent (EL) devices.

The application of the organic EL devices to a plane type display is promoted, and it is proposed to realize an active matrix display with high brightness. As regards the driving system using a low temperature polysilicon thin film transistor(TFT), it is described in SID 99 Technical Digest, pp. 372–375.

In the pixel structure, a scan line, a signal line, an EL power supply line, and a capacitance reference voltage line are arranged to intersect with one another, and in order to drive the EL device, a holding circuit of a signal voltage is formed by an n-type scan TFT and a storage capacitor. The held signal voltage is applied to a gate of a p-channel type driving TFT, and controls a conductance of a main circuit of the driving TFT. The main circuit of the driving TFT and the organic EL device are connected in series from the EL power supply line and connected to an EL common line.

In driving this pixel, a pixel selection pulse is applied from the scan line, and the signal voltage is written to the storage capacitor through the scan TFT, and is held. The held signal voltage is applied as the gate voltage of the driving TFT, and controls a drain current, according to a conductance of the driving TFT determined by a source voltage-supplied from the power supply line, and a drain voltage, and a driving current of the EL device is controlled, thereby controlling the display brightness.

However, in this system, there is a property in which even when the same signal voltage is applied in order to control the current, when the threshold value, and the on-resistance are varied, the driving current of the EL device is changed, and thus TFTs with less unevenness and having uniform characteristics are required.

As a transistor suitable for realizing such a driving circuit, there is a low temperature polysilicon TFT having a high mobility, using a user annealing process, and applicable to a large-type substrate. However, it is known that it has unevenness in the device characteristics, and when it is used as the organic EL device driving circuit, due to the unevenness of the TFT characteristics, even when the same signal voltage is applied, the unevenness in the brightness occurs in each pixel, and it has not been sufficient to display the gray scale with high precision.

Also, in JP-A-10-232649, as a driving method, the pixel is made to digitally and binary display the on/off state. As a result, since it is not necessary to use as the operating point, the neighbor of the threshold value at which the unevenness of the TFT characteristics reflects on the display significantly, there is a merit of reducing the unevenness of the brightness of the pixel. In order to obtain the gray scale display, one-frame time is divided into 8-subframes of different display times, and the average brightness is controlled by changing the light emission time.

SUMMARY OF THE INVENTION

In the digital driving system mentioned above, it is necessary to provide within the pixel a memory circuit capable of holding data of frame time or longer, and for stable memory operation, about seven transistors are necessary. However, in a pixel whose area is limited, when many transistors are included, the aperture ratio will be decreased, and when intended to obtain high resolution, the area for arranging the circuit will need 3 times as large as the analog pixel, and the high resolution becomes impossible.

An object of the present invention is to overcome the problems in the conventional technique mentioned above, and simplify the memory circuit built-in the pixel, and to provide an emissive display which has an increased aperture ratio, and high resolution.

Another object of the present invention is to provide an emissive display providing reduced power consumption of the circuit of the display.

To achieve the above-mentioned object, as to two sets of inverter circuits constituting a memory circuit arranged in each pixel, a circuit connecting an organic EL device and a transistor in series is used as one set of inverter circuit, thereby omitting a transistor in the memory circuit, simplifying the circuit, and improving the aperture ratio.

Furthermore, in the mutual connection of the two sets of inverters, by connecting so that display data is input to a line connected to a gate of the transistor connected in series with the EL device, it is possible to reduce a write load, to enable to write at high speed, and to obtain high resolution.

Furthermore, by forming a circuit configuration connected so that no through current flows by using p-channel transistors for all the transistors in the pixel, it is possible to reduce the power consumption at the memory holding period. Also, since it is possible to reduce the leakage current at the memory period, the power consumption of the circuit can be reduced.

The operation of the present invention will be explained. In the memory circuit arranged within the pixel, since the organic EL device operates as a diode, the driving transistor is connected in series, and it operates as a load device in the inverter. By this arrangement, an inverter circuit is formed, and by combining with another set of inverter circuit formed by only the CMOS transistors, it functions as a memory circuit.

In the writing of data to the pixel memory, by inputting the data so that the data is written to the gate of the driving transistor, since the gate capacitance is small, a driving load is reduced and high speed writing becomes possible.

Other objects, features and advantages of the present invention will become apparent from the following description of the embodiments of the invention taken in conjunction with the accompanying drawings.

DETAILED DESCRIPTION OF THE EMBODIMENTS

Figure 1:
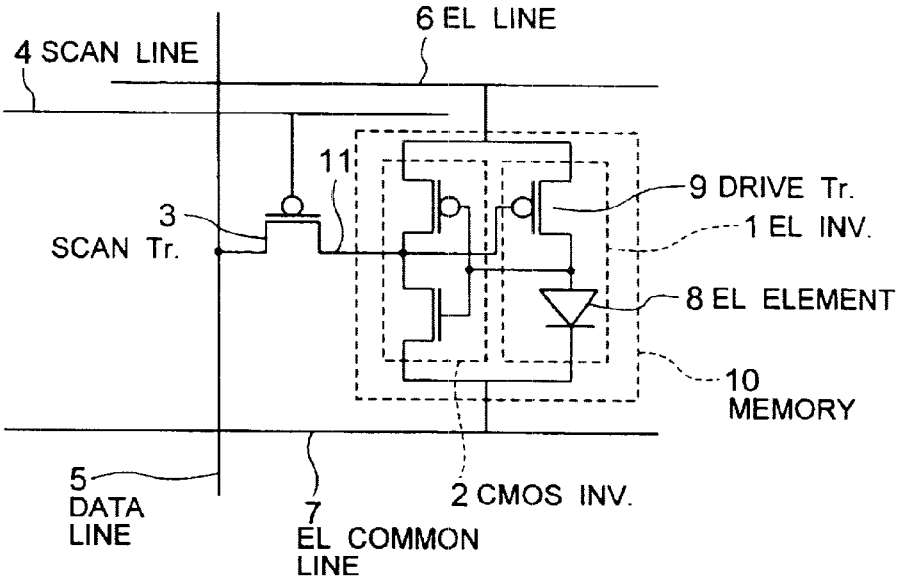
FIG. 1 is a configuration circuit diagram of a pixel circuit of an organic EL display according to one embodiment of the present invention.

Hereinafter, a plurality of embodiments of the present invention will be explained in detail by using the accompanying drawings. FIG. 1 shows a pixel circuit configuration of a display which is a first embodiment. In the pixel, a scan line 4 and a data line 5 are arranged so that they intersect with each other, and a region enclosed by the lines is a pixel region. Furthermore, an EL power supply line 6, and an EL common line 7 are connected.

In the inside of the pixel, a memory circuit 10 including an EL inverter circuit 1 comprised of an EL device 8 and a driving transistor 9, and including a CMOS inverter circuit 2 formed by CMOS connection is arranged. The memory circuit 10 is connected to the data line 5 through a main circuit of a scan transistor 3, and a gate of the scan transistor 3 is connected to the scan line 4.

Figure 2:
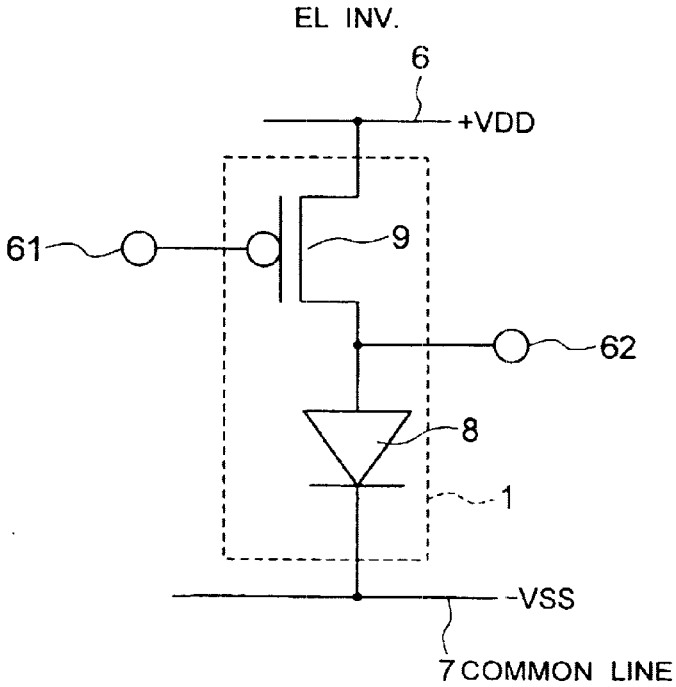
FIG. 2 is a configuration circuit diagram of an EL inverter circuit.

FIG. 2 shows the operation of the EL inverter circuit 1. The driving transistor 9 is a p-channel transistor, and its source terminal is connected to the EL power supply line 6 and its drain terminal is connected to an anode of the EL device 8, and a cathode of the EL device 8 is connected to the EL common line 7. The EL power supply line 6 and the common line 7 are connected to all the pixels in common. By applying a positive voltage to the EL power supply line 6, and a negative voltage to the EL common line 7, the input and output terminals of the inverter circuit 1 are formed in such that, the gate electrode of the driving transistor 9 functions as the input terminal 61, and a terminal connecting the driving transistor 9 to the EL device 8 functions as the output terminal 62.

Figure 3:
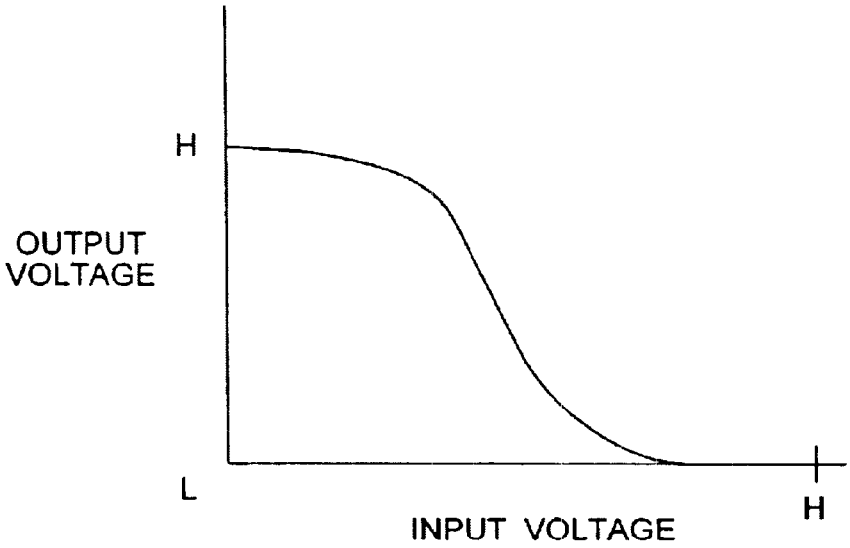
FIG. 3 is an explanation diagram showing an inverter characteristic.

FIG. 3 shows the input and output characteristic of the EL inverter circuit 1. Since the EL device 8 exhibits in its current-voltage characteristic an exponential function characteristic similar to a diode having a threshold value, when the input voltage is at a high level near the EL power supply line 6, since the driving transistor 9 is in an off state, the output terminal 62 exhibits a low voltage substantially the same as the EL common line 7. When the voltage of the input terminal 61 is gradually lowered, and upon exceeding the threshold value, the current of the main circuit of the driving transistor 9 starts to flow. As a result, corresponding to the current-voltage characteristic of the EL device 8, the output voltage rises. When the input voltage becomes further low, the current increases, the voltage of the output terminal further rises, and approaches the EL power supply voltage.

Since the EL inverter circuit 1 operates in this manner, the present circuit operates as a logical inversion circuit, that is, an inverter circuit including the EL device as a circuit device. Hereinafter, this circuit is referred to as an EL inverter circuit.

Figure 4:
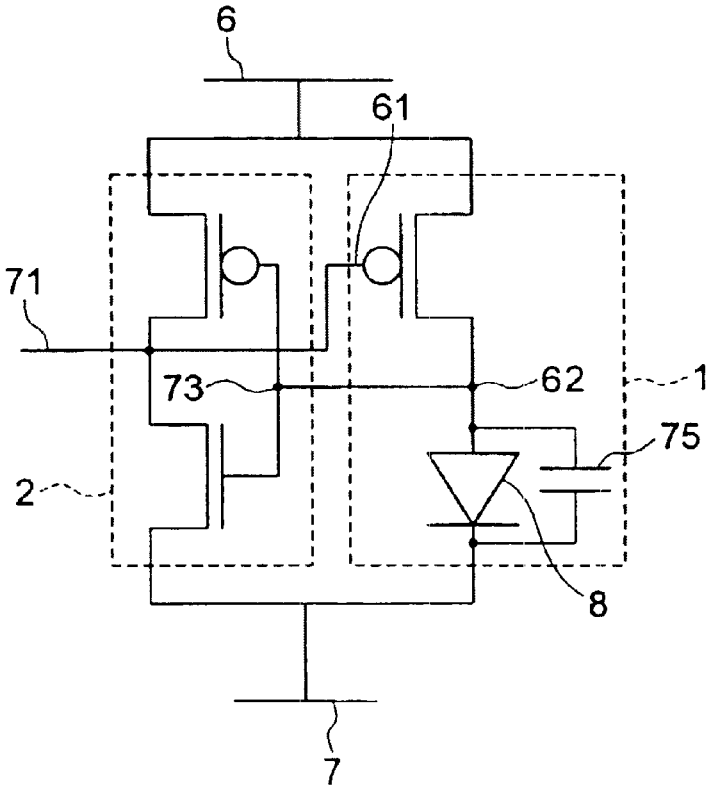
FIG. 4 is a configuration circuit diagram of a memory cell circuit of one embodiment.

FIG. 4 shows a configuration of a memory circuit which is formed by combining the EL inverter circuit with a CMOS inverter circuit. In the basic configuration of the memory, input terminals of two inverters are connected mutually to output terminals of the other. A logical state is input to this junction point from the outside as the input terminal of data, and the stable state of the circuit is controlled, and by reading out the data as the output terminal without changing the state of the circuit, this circuit is used as a memory circuit.

In FIG. 4, the input terminal 61 of the EL inverter 1 is connected to an output terminal 71 of the CMOS inverter 2. Also the input terminal 73 of the CMOS inverter 2 is connected to the output terminal 62 of the EL inverter 1, and by this connection, the combined circuit functions as a memory cell which assumes a bistable state.

When used as a memory cell, by using the input terminal 61 of the EL inverter 1 as the input terminal 71 of data, the memory cell suitable for light load and high speed operation is formed. Since this is a thin film structure formed on a wide area as far as possible within the pixel, so as to make the EL device 8 emit light, a capacitance 75 between the terminals is large. Accordingly, when the output terminal 62 of the EL inverter 1 is used as the data input terminal, a large capacitance will be obtained.

When comparing this value, the capacitance of the input terminal 61 of the EL inverter 1 is about 30 f F which can be regarded as the gate capacitance of one transistor, supposing that the size for all the transistors of the circuit; a gate length, gate width is 10 $\mu$m, gate capacitance is 0.3 fF/$\mu m^2$. On the other hand, when the output terminal of the other EL inverter is used as the data input terminal, the capacitance of the EL device becomes 1.9 pF, and the capacitance becomes large as large as 63 times, supposing that the pixel size is 100 $\mu m^2$, the aperture ratio is 70%, the thickness of the EL device is 0.1 $\mu$m, and the average relative dielectric constant $\epsilon$ of the EL device is 3.

For this reason, when the data is written through the matrix line, it takes a long time, and the driving of a high resolution panel having a short scan time, and a large-size panel having an increased line resistance becomes difficult. Therefore, it is an important point in order to achieve the high performance to use the junction point between the input terminal 61 of the EL inverter circuit 1 and the output terminal 71 of the CMOS inverter circuit 2 as an input terminal of the memory cell.

The operation of the pixel configuration using the memory cell mentioned above will be explained. In the memory circuit of FIG. 1, the input terminal 11 of the memory cell 10 is connected to the data line 5 through the main circuit of the scan transistor 3, and the conductivity of the scan transistor 3 is controlled by the voltage of the scan line 4.

Figure 5:
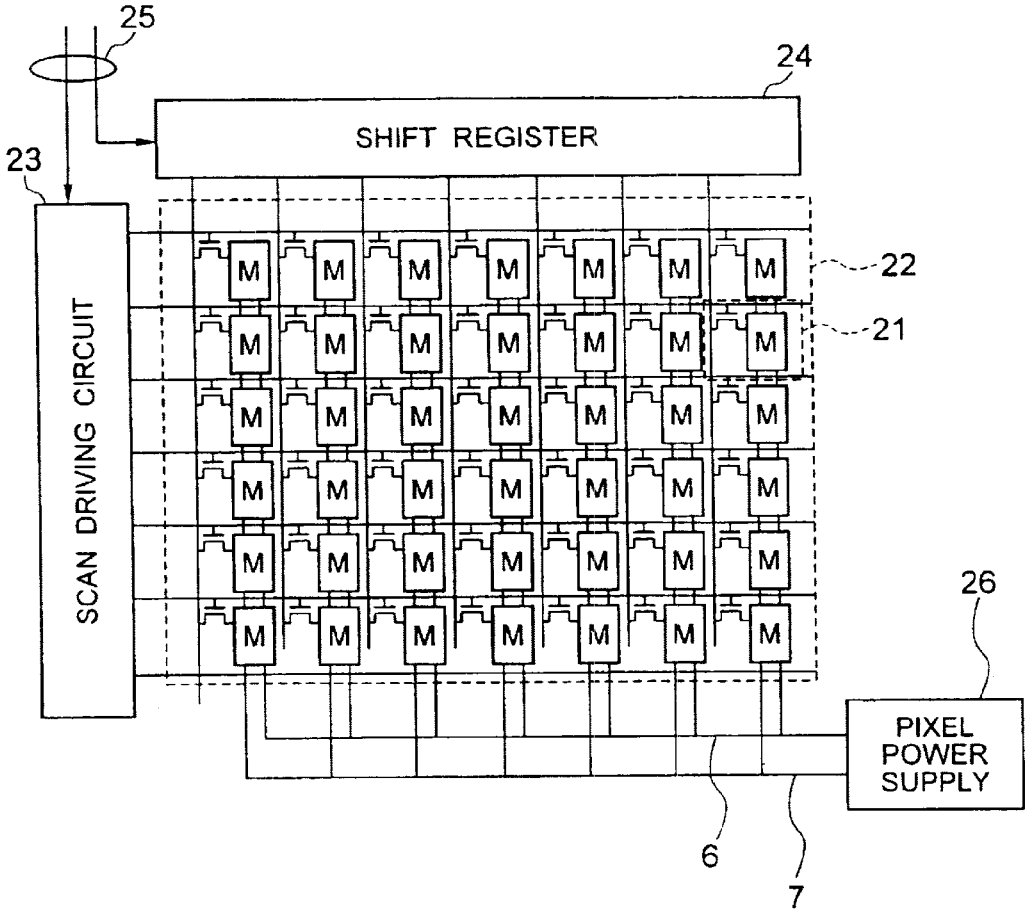
FIG. 5 is a block diagram showing a configuration of the organic EL display.

FIG. 5 shows an embodiment of the present invention. A display region 22 is formed by arranging the pixels 21 each containing therein the memory cell explained in FIG. 1, and in order to drive the matrix, a shift register 24 is connected to the data line, and a scan driving circuit 23 is connected to the scan line. The control signal for controlling the circuit operation and the display data are supplied through an input line 25. Also the EL power supply line 6 of the pixels 21 and the EL common line 7 are together connected to a pixel power supply 26.

According to the present embodiment, the feature is that the driving circuit has a simple configuration because a high speed writable memory is contained within the pixel, and in the driving circuit around the display region, it is only necessary to provide a digital shift register.

Figure 6:
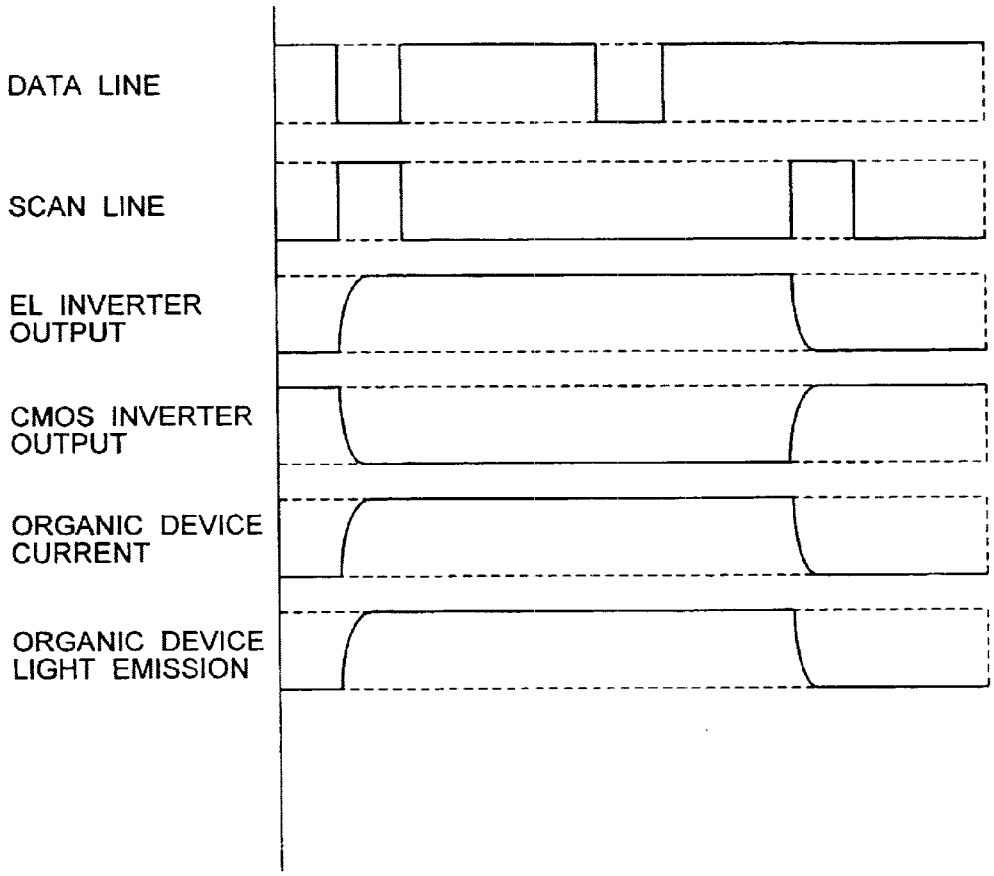
FIG. 6 is an operation waveform diagram of a pixel circuit according to one embodiment.

FIG. 6 shows the display operation of the pixel. A scan pulse for sequentially scanning the matrix in one frame period is applied to the scan line. Binary data of high and low levels corresponding to on and off states of the pixels in the row of the matrix is supplied to the data line. At the timing at which the scan pulse is applied, a voltage state of the data line is fetched into the memory cell. At this time, when the data is at the L-level, the output of the EL inverter is inverted to become the H-level. On the other hand, the output of the CMOS inverter on the contrary becomes the L-level, and this level is held in the memory cell. At this time, since the transistor in the EL inverter is in a conduction state, the current flows in the EL device, and the organic EL device becomes the light emission state.

Furthermore, when the data line is at the H-level at the time when the scan pulse is applied, the output of the EL inverter is changed to L-level, and the output of the CMOS inverter is changed to H-level. In this state, since the current does not flow the EL device, it becomes light non-emission state. As mentioned above, the pixel can operate to fetch the voltage state of the data line into the memory cell in response to the scan pulse.

Figure 7:
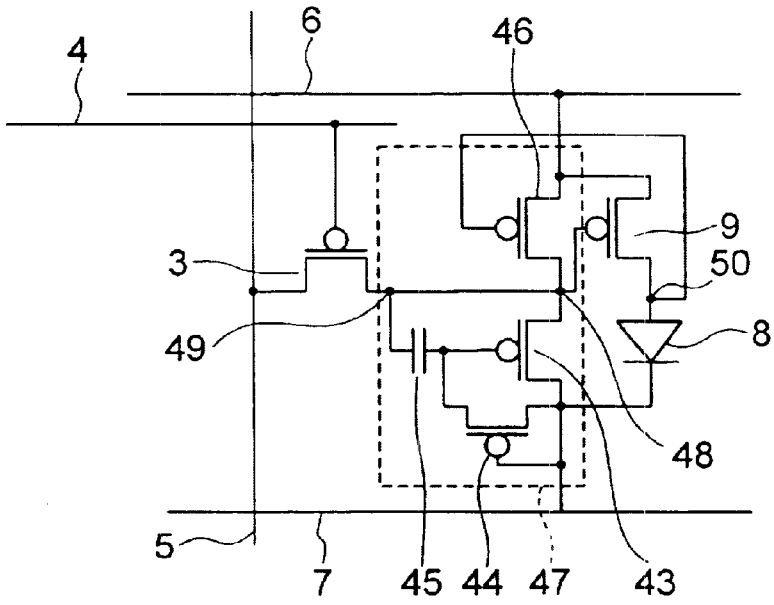
FIG. 7 is a configuration circuit diagram of a pixel circuit by a PMOS inverter.

Next, a second embodiment shown in FIG. 7 will be explained. In the present embodiment, the transistors within the pixel are all formed by only p-channel type having the same threshold value characteristic. By this configuration, the feature is that the transistor fabrication process is simplified, and it is possible to manufacture at low cost.

In the circuit configuration, the EL device 8 and the driving transistor 9 have the same configuration as the first embodiment. The other set of inverter is not the CMOS inverter, but a PMOS inverter 47 in which all the transistors are formed by p-channel transistors. The operation of this circuit will be explained below.

The PMOS inverter 47 is formed by two p-channel transistors including a reset transistor 46 and a set transistor 43, and one MOS diode which is a bias diode 44, and a bias capacitance 45. The set transistor 43 is turned on when it changes the output of inverter 47 to a L-(logical low) level. In order to change the output of the set transistor 43 to the L-level, which is the p-channel type, the gate voltage of the set transistor 43 is made to be lower than the voltage of the EL common line 7 by the bias capacitance 45 and the bias diode 44. The reset transistor 46 is turned on when its output is made to change to H-(logical high) level.

When connected in this manner, the PMOS inverter 47 has its input terminal 49 connected to the input terminal 48 of the EL inverter, and the output terminal 50 is connected to the gate of the reset transistor 46. Also, the input terminal 49 is connected to the gate of the driving transistor 9. Since the gate terminal 49 of the set transistor 43 is always connected to the diode 44, it is normally at the voltage value of the EL common voltage, and the set transistor 43 is in the off state.

Here, as the input signal, when the data signal is changed from the H-level to L-level, since it is capacitance-coupled by the bias capacitance 45, the gate terminal 49 of the set transistor 43 is pulled down. As a result, the set transistor 43 conducts, and the output terminal 48 is changed to L-level. Consequently, since the EL inverter produces a logical inversion signal, the output terminal 50 becomes H-level and the EL device is turned on. The gate voltage of the reset transistor 46 is at H-level, and the reset transistor 46 becomes off state. Thus, the output 48 of the PMOS inverter 47 holds the L-level.

Next, in the case where the input 49 of the pixel changed to H-level, the gate of the set transistor 43 becomes off state due to the capacitance coupling. Since it is connected also to the gate of the driving transistor 9, the output 50 of the EL inverter is changed to L-level, and by this the reset transistor 46 becomes on state, and the output of the PMOS inverter 47 changes to H-level.

As mentioned above, this pixel circuit is a bistable circuit in which the output terminal of the EL inverter circuit is able to hold H- or L-level, and it possesses the function as a memory. Furthermore, in the PMOS inverter 47, since the current flows only when the state of the circuit is changed, regardless of the fact that it is a logical circuit formed by only the PMOS transistors, there is an advantage that the power consumption is very small. In this respect, the diode may be replaced by a resistor, and in the case of the resistor, an alternating current coupling circuit including a time constant circuit is connected to the input circuit of the set transistor 43. As the resistor, a high resistance layer such as i-Si (intrinsic silicon) etc. may be used, and which makes the device structure simple as compared with the diode. Also, since it is only necessary to control the time constant, the writing at high speed becomes possible.

Figure 8:
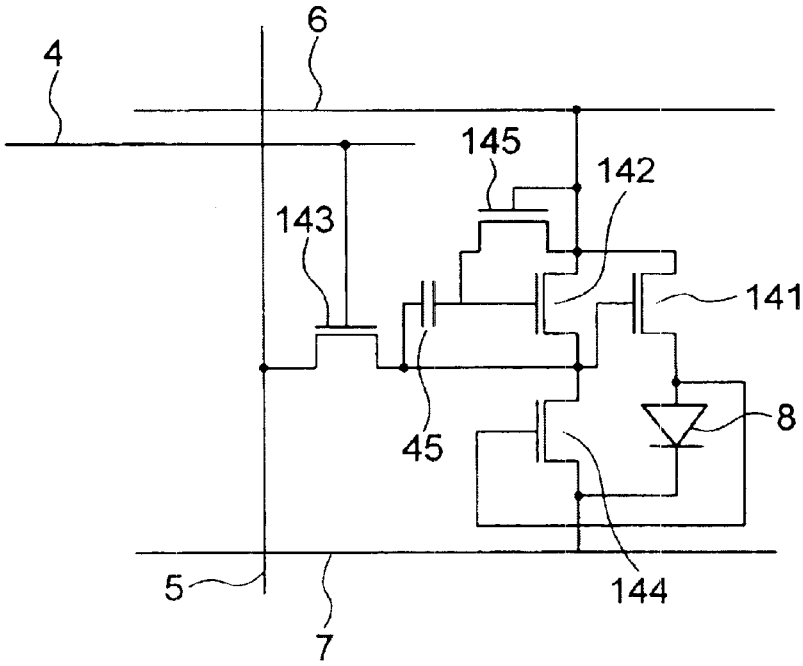
FIG. 8 is a configuration circuit diagram of a pixel circuit by n-channel transistors.

Furthermore, as a circuit configuration for small power consumption, there is a third embodiment in which all the transistors are formed by n-channel type transistors. As shown in FIG. 8, all the transistors are formed by N-type. They are a scan transistor 143, set transistor 142, reset transistor 144, and bias diode 145.

The circuit operation is the same as the second embodiment. When it is intended to form this circuit with thin-film transistors, since it is possible to reduce the current during off state of the transistors to a great extent by employing the leakage current reducing structure such as a LDD structure with N-ch TFT, and a series connection configuration of transistors, the power consumption of circuit can be further reduced as compared with the second embodiment. As to the configuration for reducing the leakage current, a general method may be used.

In the second and third embodiments, when the on state of pixel is continued, both the set transistor and the reset transistor enter the off state. Then the voltage of the input terminal of the EL inverter gradually rises from the L-level due to the leakage current of the scan transistor, and becomes unstable and the current of the driving transistor gradually decreases. Therefore, this situation is avoided by applying a H level voltage each time the data signal is scanned.

Figure 9:
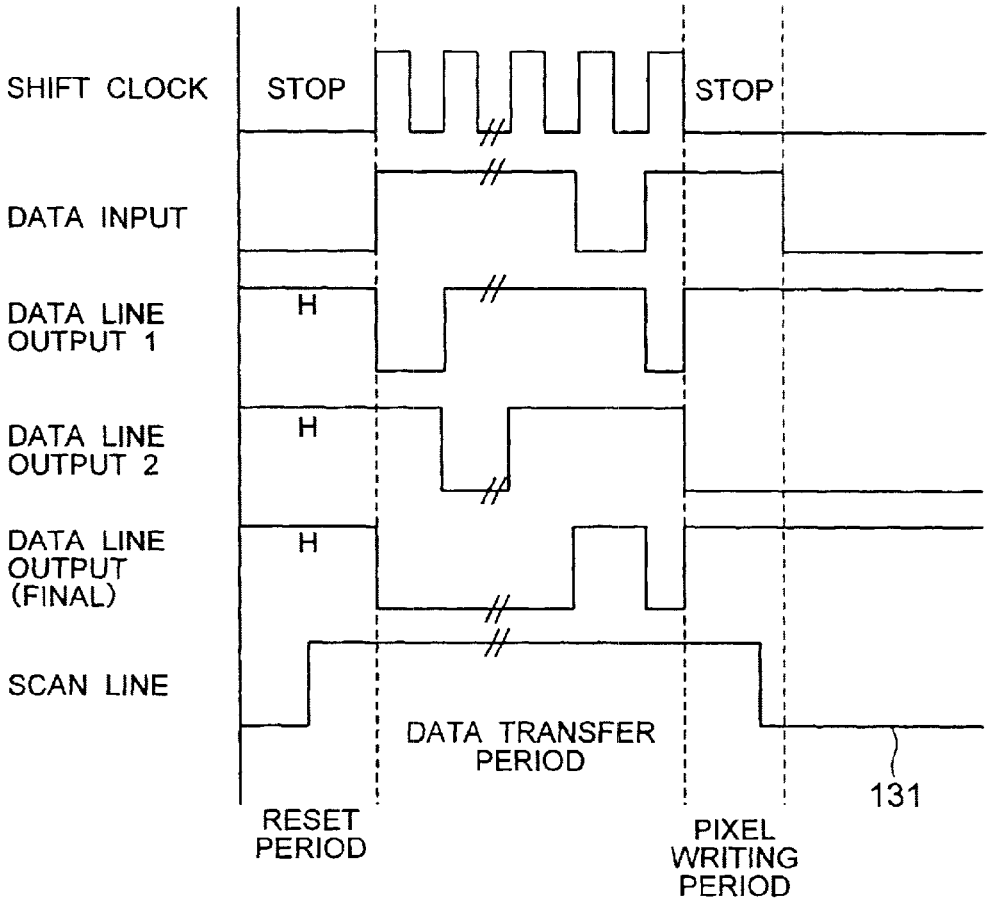
FIG. 9 is an operation waveform diagram of a shift register.

FIG. 9 shows the operation of the shift register. Within a period during which a scan pulse 131 is applied to the scan line, shift clocks are applied during a period in which data is being shifted. In the period of the scan pulse 131, first, all the data line output terminals go to H-level together. During this period, PMOS inverter input terminals of all the pixels on one line go to H-level. This period must be held for at least the propagation delay time of the data line. Thereafter, the data is sequentially aligned for one line by the shift register. Thereafter, the state of each data output is held for the propagation delay time or longer of the data line, and the data is fetched to the pixel, and the scan pulse finishes.

In order to realize the operation mentioned above, initializing means is provided in a latch of each stage of the shift register so that the latch becomes H-level in the reset state, and the shift clock may be applied intermittently.

Figure 10:
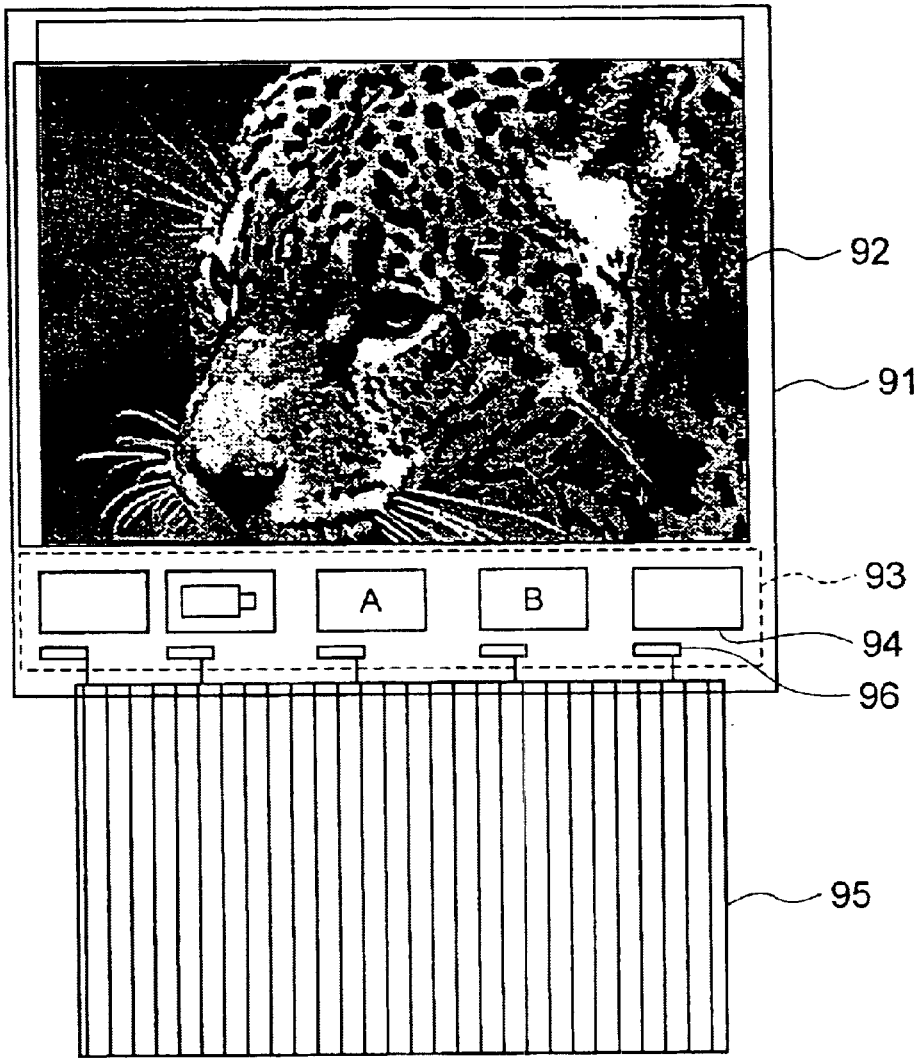
FIG. 10 is a schematic configuration diagram of a display.

FIG. 10 shows a fourth embodiment. This is an example of configuration of a panel of a portable telephone and the like, and a video display region 92 by an organic EL device matrix driven by a TFT and a peripheral driving circuit, and organic EL device indicator 93 are formed on the same glass substrate 91, and a data control signal and a power supply are supplied through a flexible print substrate 95.

The pixel circuit 96 is connected to drive the organic EL device indicator 93, and the pixel circuit 96 is used not only for the matrix pixel having a feature of memory function and low power driving, but also as the display driving control circuit of individual organic EL device indicator. Thus, by turning off the video display, and turning on the indicator 94 only, and by rewriting by applying the data and the scan pulse and the control signal to the pixel circuit 96 only when the display condition is to be changed, it is possible to reduce the power at the time of stand-by.

Figure 11:
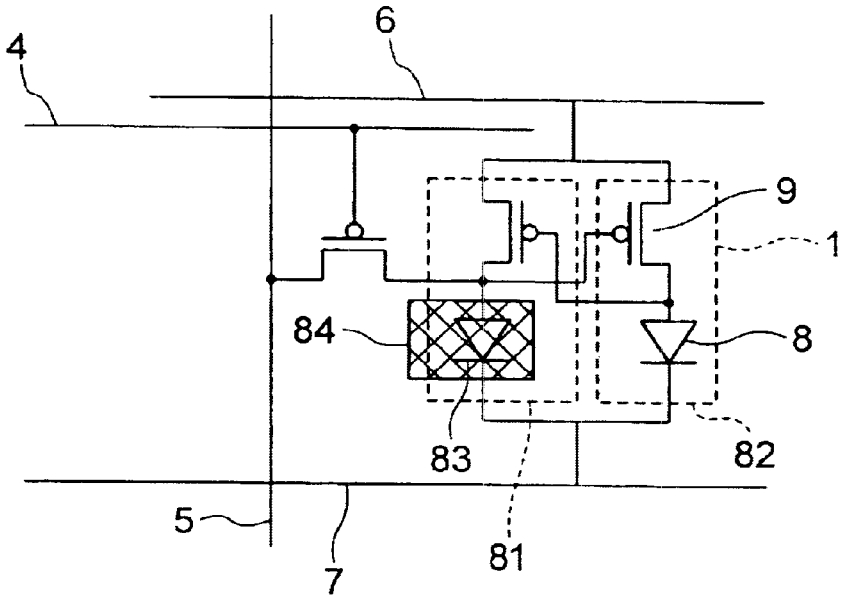
FIG. 11 is a configuration circuit diagram of a pixel circuit by two EL inverter circuits.

FIG. 11 shows a fifth embodiment. In the present embodiment, the input and output terminals of two inverters including a logical EL inverter 81 and a display EL inverter 82 are mutually connected, and a pixel circuit is formed by only three transistors. In this case, since the EL devices are alternately turned on responsive to the memory state, by making the area of the load EL device 83 smaller than the EL device used for display, and by providing a covering layer 84 to cover the light emission portion so that the display is not disturbed, the number of the transistors can be decreased without degrading the display contrast.

Figure 12:
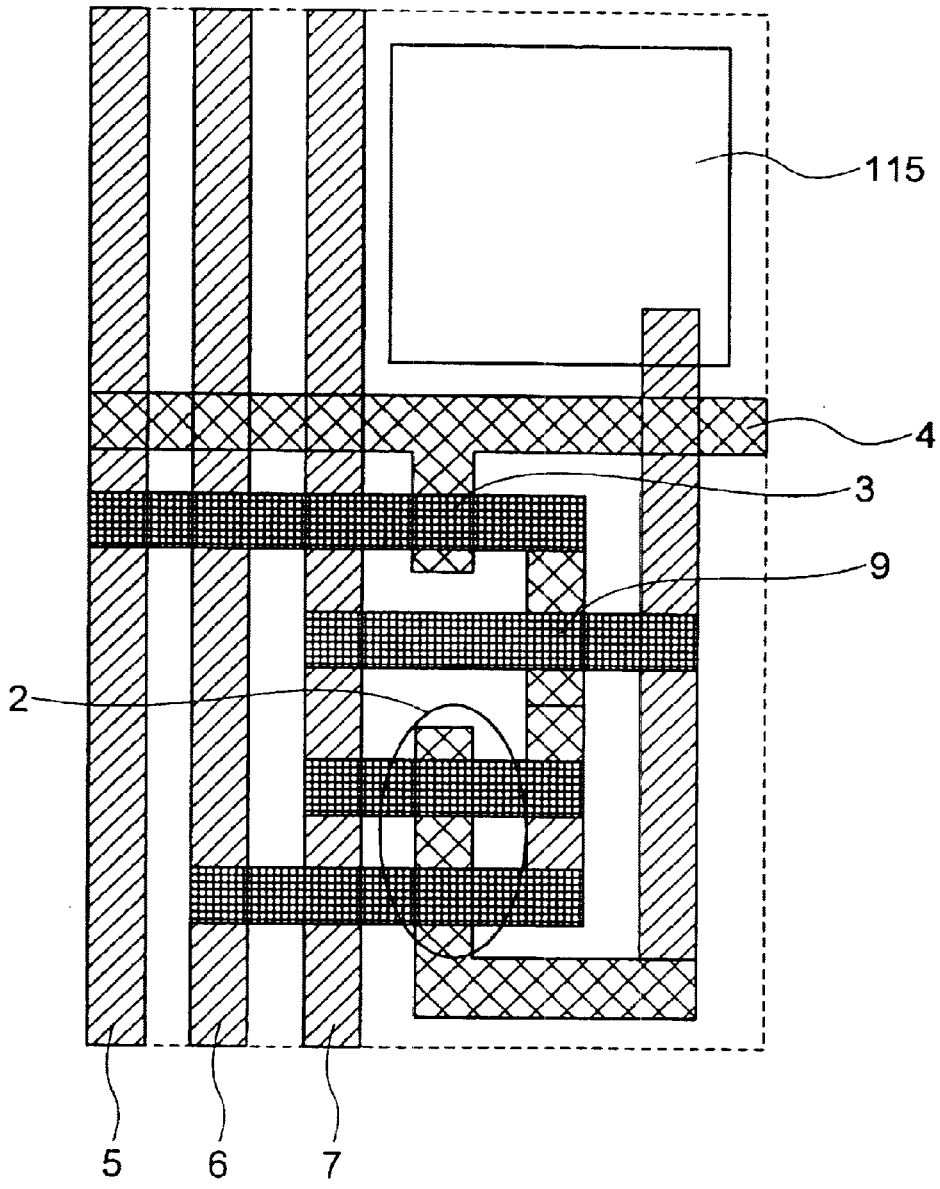
FIG. 12 is a diagram showing a mask layout of a pixel circuit.

FIG. 12 is a mask layout diagram of the pixel circuit shown in FIG. 1. The scan line 4, data line 5, EL power supply line 6, EL common line 7, CMOS inverter 2, driving transistor 3, and EL display electrode 115 are arranged. Although not shown, an organic EL layer, and an EL cathode layer connected to the common line 7 with the same voltage are deposited on all over the surface of the pixel. As shown, the EL power supply line 6, and EL common line 7 are arranged in the vertical direction, so that they are aligned orthogonal to the scan line, and by virtue of this, an advantage is obtained in which at the time of line sequential driving, even when the loads for each column are varied simultaneously, since the current on the power supply line 6 is stable and not varied, the memory content is also stable and satisfactory display is provided.

Figure 13:
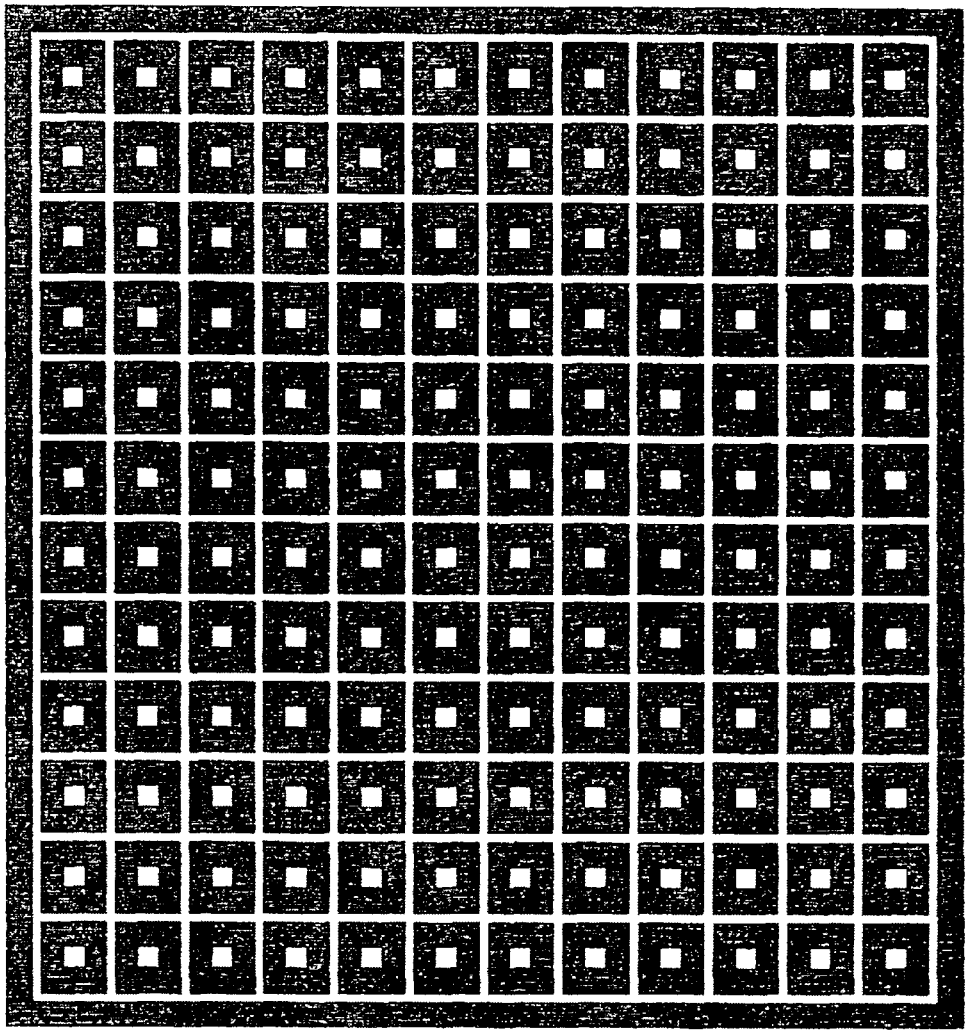
FIG. 13 is a macroscopic diagram of a display pixel light emission portion.

Furthermore, when many lines are arranged in the vertical direction, the EL display electrode 115 will become small and narrow, however, the display in the case where the light emission region occupying the pixel is small, as shown in the pixel light emission condition diagram in FIG. 13, the light emission occurs at very small portion within the pixel arranged in matrix.

Figure 14:
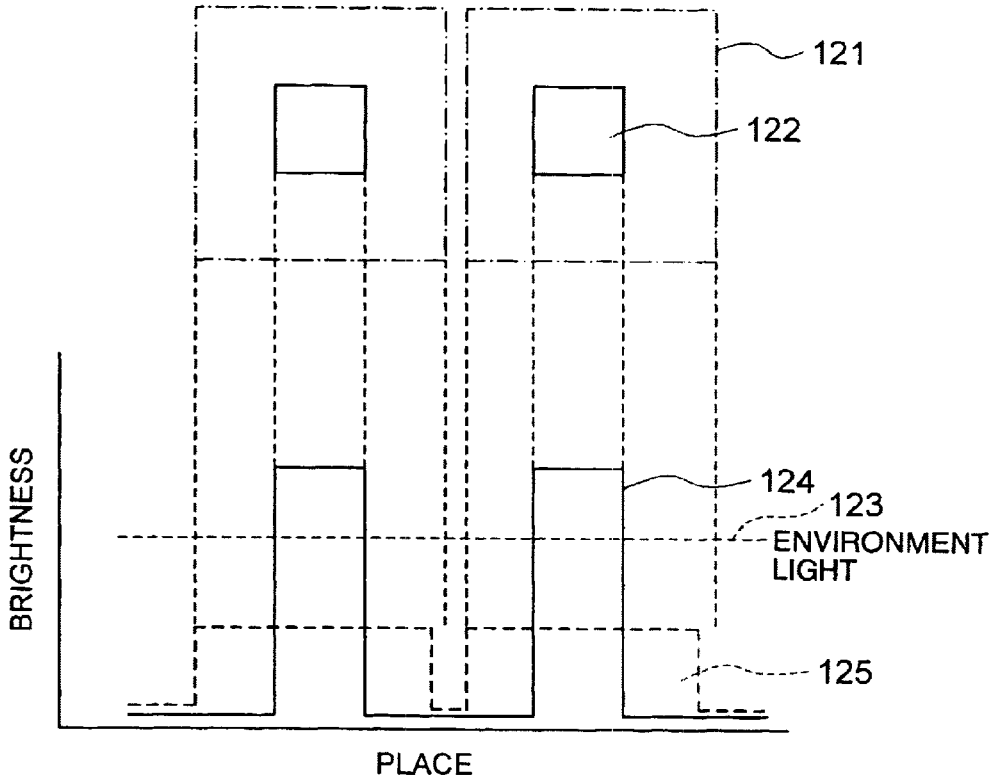
FIG. 14 is an explanation diagram showing a light emission intensity distribution.

The brightness condition of this pixel is shown in FIG. 14. The place dependency of the light emission brightness in a narrow and small pixel light emission region 122 and a wide light emission region 121 is shown. In the case where an average brightness of the whole pixel is combined, in the narrow and small pixel brightness 124, a brightness higher than the brightness 125 of a wide pixel appears in a spot-like, as a result, even when the environment light 123 is high, since the brightness of the light emission portion is high, the interpretation of the display becomes easy. This enables to see the display in good condition even at the light place with limited power such as a portable telephone, and there is a feature that the display easily visible can be provided with low power.

The intensity of environment light, supposing in the outdoor, is 10000 lux, and considering that the light illuminates a complete diffusion surface, the brightness of reflected light is 3000 cd/m$^2$ or larger. At this time, the relationship between the average brightness and the brightness of light emission portion, the aperture ratio is expressed in the equation (1) below.

$$\text{average brightness} = \text{brightness of light emission portion} \times \text{aperture ratio} \quad (1)$$

Here, when substituting >3000 (cd/m$^2$) as the outdoor environment light for the brightness of light emission portion in equation (1), it becomes that aperture ratio <average brightness/3000. For example, since the average brightness in the notebook type personal computer is 100 (cd/m$^2$), the aperture ratio of the light emission portion may be 3%. In this manner, by determining the aperture ratio from equation (1), it is possible to visualize the display even in the light environment.

In this respect, since the aperture ratio of the pixel in FIG. 12 is 15%, supposing that the average brightness is 450 (cd/m$^2$), a desired display characteristic can be obtained. In particular, by combining with the pixel having the memory built-in according to the present invention, since it is possible to visualize a satisfactory display excellent in the uniformity of display characteristic under the outdoor environment light, it is suitable for the portable information equipment such as a portable telephone, portable TV set, etc.

According to the present invention, since it is possible to simplify the memory circuit built-in the pixel of the emissive display, an advantage is provided in which a high resolution image can be realized. Also, the power consumption of the circuit of the display is reduced. Furthermore, under the environment light, the display excellent in the uniformity of display characteristic can be provided.

What is claimed is:

1. An emissive display having pixels enclosed by a plurality of scan lines, and a plurality of signal lines intersecting with each other, wherein each pixel includes a memory circuit including first and second inverter circuits, said first inverter circuit including an electroluminescent device formed by an organic multi-layers driven by a current as a load device, and including a display control circuit connecting in series a main circuit of at least one first transistor, and said memory circuit stores display information of said pixel according to a conduction state or a non-conduction state of the main circuit of the first inverter, and controls an on state and an off state of said electroluminescent device on a binary basis.

2. An emissive display according to claim 1, wherein said second inverter circuit uses a CMOS transistor.

3. An emissive display according to claim 1, wherein said memory circuit constitutes a bistable circuit in which an input terminal of one of said first and second inverter circuits is mutually connected to an output terminal of the other of said first and second inverter circuits, and a gate terminal portion of the transistor forming said first inverter circuit is connected to said signal line through a main circuit of a second transistor, and a gate of said second transistor is connected to the scan line, thereby to provide an input circuit for inputting data to be stored in said memory circuit.

4. An emissive display having a pixel enclosed by a plurality of scan lines, and a plurality of signal lines intersecting with each other, wherein said pixel includes a memory circuit including first and second inverter circuits, said first inverter circuit including an electroluminescent device formed by an organic multi-layers driven by a current as a load device, and including a display control circuit connecting in series a main circuit of at least one first transistor, said memory circuit constitutes a bistable circuit in which an input terminal of one of said first and second inverter circuits is connected to an output terminal of the other of said first and second inverter circuits, and in said memory circuit display information of said pixel is stored in response to a conduction state and a non-conduction state of the main circuit of the first inverter, and an on state and an off state of said electrpluminescent device are binary controlled, and a series-parallel conversion circuit using a shift register is provided at around the display region aligned with said pixel, and an output of each stage of said shift register is connected to the signal line.

5. An emissive display having a pixel enclosed by a plurality of scan lines, and a plurality of signal lines intersecting with each other, said emissive display comprising a memory circuit including:

a first inverter circuit including a main circuit of a third transistor and an organic electroluminescent device connected in series between a power supply line and a reference voltage line;

a sampling circuit connected to an input terminal of said first inverter circuit for controlling the connection with said signal line in response to a scan pulse applied through said scan line;

a set circuit for controlling the connection between said power supply line and the input terminal of said first inverter circuit, by an output of said first inverter circuit; and a reset circuit for controlling the connection between the reference voltage line and the input terminal of said first inverter circuit, by a signal voltage sampled by said sampling circuit, wherein in said memory circuit, display information of the pixel is stored in response to a conduction state and a non-conduction state of the main circuit of the first inverter, and an on state and an off state of said electroluminescent device are binary controlled.

6. An emissive display according to claim 5, wherein in said set circuit or said reset circuit, there is provided with an AC coupling circuit formed by using a capacitance and a diode or a resistor in order to apply an input signal exceeding a voltage of the power supply or the reference voltage to a gate terminal of the transistor, and all the transistors of said pixel are formed by P-type or N-type.

7. An emissive display according to claim 5, wherein a signal shift register capable of outputting a binary signal is connected to said signal line, and a scan line driver circuit generating a scan pulse to select the pixel is connected to said scan line, and an initialized period is provided in said signal shift register so that said signal line applies a logical signal to turn off said electoluminescent device within a scan pulse period.

8. An emissive display having pixels enclosed by a plurality of scan lines, and a plurality of signal lines intersecting with each other, wherein each pixel includes a memory circuit including first and second inverter circuits, said first and second inverter circuits include an electroluminescent device formed by a multi-layers driven by a current as a load device, and a display control circuit connecting in series a main circuit of at least one first transistor, said memory circuit stores display information of said pixel according to a conduction state or a non-conduction state of the main circuit of the inverter, and includes covering means to cover the electroluminescent device of said second inverter circuit, and controls an on state and an off state of said electroluminescent device on a binary basis.

9. An emissive display having a pixel enclosed by a plurality of scan lines, and a plurality of signal lines intersecting with each other, wherein said pixel includes a memory circuit including an inverter circuit, said inverter circuit includes an electroluminescent device formed by organic multi-layers driven by a current as a load device, and a display control circuit connecting in series a main circuit of at least one first transistor, said memory circuit stores, display information of the pixel according to a conduction state or a non-conduction state of the main circuit of the inverter, and controls an on state and an off state of said electroluminescent device on a binary basis.

10. An emissive display according to claim 1, wherein in said pixel, a relationship of an aperture ratio <an average brightness/3000 is present between the aperture ratio and the average brightness, where the aperture ratio is the area ratio of the area of light emission area to the pixel area.

11. An emissive display according to claim 1, wherein a power supply and reference voltage line of said inverter circuit are arranged in a vertical direction of the pixel, and a relationship of an aperture ratio <an average brightness/3000 is present between the aperture ratio and the average brightness, where the aperture ratio is the area ratio of the area of light emission area to the pixel area.

* * * * *